US009959719B2

(12) United States Patent
Pai et al.

(10) Patent No.: US 9,959,719 B2
(45) Date of Patent: May 1, 2018

(54) ADJUSTABLE DOOR SENSOR

(71) Applicant: Salus North America, Inc., Redwood City, CA (US)

(72) Inventors: Samuel Hong-Yen Pai, San Francisco, CA (US); Wai-Leung Ha, Hong Kong (HK); Shen Owyang, San Francisco, CA (US); Dick Kwai Chan, Hong Kong (HK); Wai Yin Shum, Hong Kong (HK); Kwok Wa Kenny Kam, Hong Kong (HK); Guang Quan Feng, Shenzhen (CN)

(73) Assignee: Salus North America, Inc., Redwood City, CA (US)

( * ) Notice: Subject to any disclaimer, the term of this patent is extended or adjusted under 35 U.S.C. 154(b) by 0 days. days.

(21) Appl. No.: 15/697,694

(22) Filed: Sep. 7, 2017

(65) Prior Publication Data

US 2017/0365142 A1 Dec. 21, 2017

Related U.S. Application Data

(63) Continuation-in-part of application No. 14/984,222, filed on Dec. 30, 2015, now Pat. No. 9,761,098.

(60) Provisional application No. 62/099,818, filed on Jan. 5, 2015.

(51) Int. Cl.
*G08B 13/08* (2006.01)
*H01H 13/18* (2006.01)

(52) U.S. Cl.
CPC ..... *G08B 13/08* (2013.01); *H01H 13/183* (2013.01)

(58) Field of Classification Search
CPC ..... G08B 13/08; H01H 13/183
See application file for complete search history.

(56) References Cited

U.S. PATENT DOCUMENTS

| | | | |
|---|---|---|---|
| 4,329,681 | A | 5/1982 | Parsons |
| 4,406,935 | A | 9/1983 | Montag et al. |
| 4,739,133 | A | 4/1988 | Nation et al. |
| 4,915,431 | A | 4/1990 | Bailey |
| 5,572,190 | A | 11/1996 | Ross et al. |
| 6,609,738 | B1 | 8/2003 | Roth et al. |
| 6,724,316 | B2 | 4/2004 | Addy et al. |
| 6,737,969 | B2 | 5/2004 | Carlson et al. |
| 7,081,816 | B2 | 7/2006 | Schebel et al. |
| 7,292,145 | B2 | 11/2007 | Castle et al. |
| 8,212,670 | B2 | 7/2012 | Schebel et al. |

(Continued)

OTHER PUBLICATIONS

May 3, 2016—(EP) Extended Search Report—App 16150065.5.

*Primary Examiner* — Nader Bolourchi
(74) *Attorney, Agent, or Firm* — Banner & Witcoff, Ltd.

(57) ABSTRACT

An entry sensor, which supports either wireless or wired operation, facilitates installation and is adjustable for gaps between a building entry barrier such as a door or window and the surrounding frame. The sensor, which may be implemented as a single piece design, includes an adjustment mechanism that enables an installer to vary the extension of the sensor to match the actual gap so that the sensor properly secures the building entry when closed. The sensor includes a detector that determines the state of a switch that is responsive to the movement of a plunger mechanism, where the state is indicative whether the building entry barrier is opened or closed, and that may determine whether the sensor is tampered with. The sensor also may facilitate battery replacement that protects the associated circuitry during the replacement.

15 Claims, 7 Drawing Sheets

(56) References Cited

U.S. PATENT DOCUMENTS

| | | | |
|---|---|---|---|
| 8,653,972 | B2 | 2/2014 | Schebel et al. |
| 2001/0050486 | A1 | 12/2001 | Bunting |
| 2014/0062466 | A1 | 3/2014 | Thibault et al. |

ADJUSTABLE DOOR SENSOR

The application is a continuation-in-part application to U.S. Non-Provisional application Ser. No. 14/984,222, filed Dec. 30, 2015 which claims priority to U.S. provisional patent application Ser. No. 62/099,818 entitled "Adjustable Door Sensor" filed on Jan. 5, 2015, which is hereby incorporated by reference in its entirety.

TECHNICAL FIELD

Aspects of the disclosure relate to an adjustable sensor for securing a building opening such as a door or window that adapts to the gaps between the moving and stationary portions of the opening and the covering. For example, the amount of the actuator's depth may be adjusted through a screw type structure with mechanism to secure the adjusted depth.

BACKGROUND

Residential and commercial burglaries are an endemic problem throughout the world. For example, homeowners in the United States are victims of burglary about every 15 seconds. The typical homeowner suffers a loss of nearly $2,000 in stolen goods or property damage. Approximately two million home burglaries are reported each year in the United States and about 30 percent of all burglaries are through an open or unlocked window or door. Moreover, one of three residential assaults is a result of a burglary. Consequently, an approach that facilitates the securing doors and windows in a building may offer a significant benefit to people.

BRIEF SUMMARY

Aspects described herein address one or more of the issues mentioned above by disclosing methods, computer readable media, and apparatuses that support an adjustable building entry sensor for securing a building barrier such as a door or window.

With one aspect, embodiments support adjustable contact switching as well as facilitating battery replacement that protects the associated circuitry during the replacement.

With another aspect, an entry sensor, which supports either wireless or wired operation, facilitates installation and is adjustable for gaps between a door or window and the surrounding frame. The sensor, which may be implemented as a single piece design, includes an adjustment mechanism that enables an installer to vary the extension of the sensor to match the actual gap so that the sensor properly secures the building entry when closed. The sensor includes a detector that determines the state of a switch that is responsive to the movement of a plunger mechanism, where the state is indicative whether the building entry is opened or closed, and that may determine whether the sensor is tampered with. The sensor also may facilitate battery replacement that protects the associated circuitry during the replacement.

With another aspect, a sensor device for a building barrier comprises a plunger, a sensor housing, a switch, and a linkage. The plunger is adapted to engage either the surrounding frame or the building barrier to secure the building barrier when in a closed position and to disengage the surrounding frame or building barrier when the building barrier is in an opened position. The sensor housing has an adjustment mechanism that is adapted to adjust a depth of the plunger with respect to the surrounding frame or building barrier. The adjustment, in turn, comprises a threaded portion that is adjustably inserted through a hole in either the building barrier or surrounding frame, and driver slots enabling the threaded portion to be externally adjusted. The switch has first and second states indicative of the closed and opened positions of the plunger, respectively. The linkage couples the plunger to the switch, where the linkage moves responsive to movement of the plunger.

With another aspect, a sensor device comprises a sensing circuit that is electrically connected to the switch. The sensing circuit includes a detector to determine the state of the switch, a processing device that determines state information from the detected state, and a communication device that sends a signal indicative of the state information over a communication channel.

With another aspect, a sensor device comprises a housing, a plunger body, a plunger cap, and a switch. The plunger body has a threaded portion and a rod, where the plunger body is adapted to travel within the housing. The plunger cap is adapted to be adjustable to a desired depth with respect to the surrounding frame or building barrier by rotating the plunger cap via the threaded portion of the plunger body. The plunger cap is further adapted to engage the surrounding frame or building barrier to secure the building barrier when in a closed position and to disengage the surrounding frame or building barrier when the building barrier is in an opened position. The switch has first and second states indicative of the closed and opened positions, respectively. The rod couples the plunger body to the switch and moves in response to movement of the plunger body.

Aspects of the embodiments may be provided in a computer-readable medium having computer-executable instructions to perform one or more of the process steps described herein.

These and other aspects of the embodiments are discussed in greater detail throughout this disclosure, including the accompanying drawings.

BRIEF DESCRIPTION OF THE DRAWINGS

The foregoing summary of the invention, as well as the following detailed description of exemplary embodiments of the invention, is better understood when read in conjunction with the accompanying drawings, which are included by way of example, and not by way of limitation with regard to the claimed invention.

DETAILED DESCRIPTION

Door sensors may be controlled via wired and wireless means. For ease of installation of the sensor, a single unit rather than a two-piece design may be preferred. However, according to traditional approaches, a single unit plunger design may have a number of deficiencies. For example, a fixed amount of travel of the contact switch may make it difficult to fit all door gaps, and a minimum gap distance may be required for the mounting flange. Also, with wireless sensors, short battery life and/or wireless range may result from a small battery, in which changing the battery may expose circuitry to possible damage.

Traditional approaches often use spacers to adjust plunger travel to door gap width. With wireless sensors, small batteries are often used in order to keep the diameter of mounting hole small. With some traditional approaches, wireless sensors may use a larger battery; however, changing the battery may require removal of the circuitry from the housing.

With an aspect of the invention, embodiments support adjustable contact switching as well as facilitating battery replacement that protects the associated circuitry during the replacement.

With an aspect of the invention, a sensing device detects when a door opens. The sensing device is easy to install and infinitely adjustable for the gaps between the door and the door jamb or lintel. The device may be implemented as a wired or a wireless device, incorporating terminals for connection to a wired system, or a wireless transceiver for connection to a wireless system. For wireless versions, this design allows the circuitry to be protected while replacing the battery.

Figure 1:
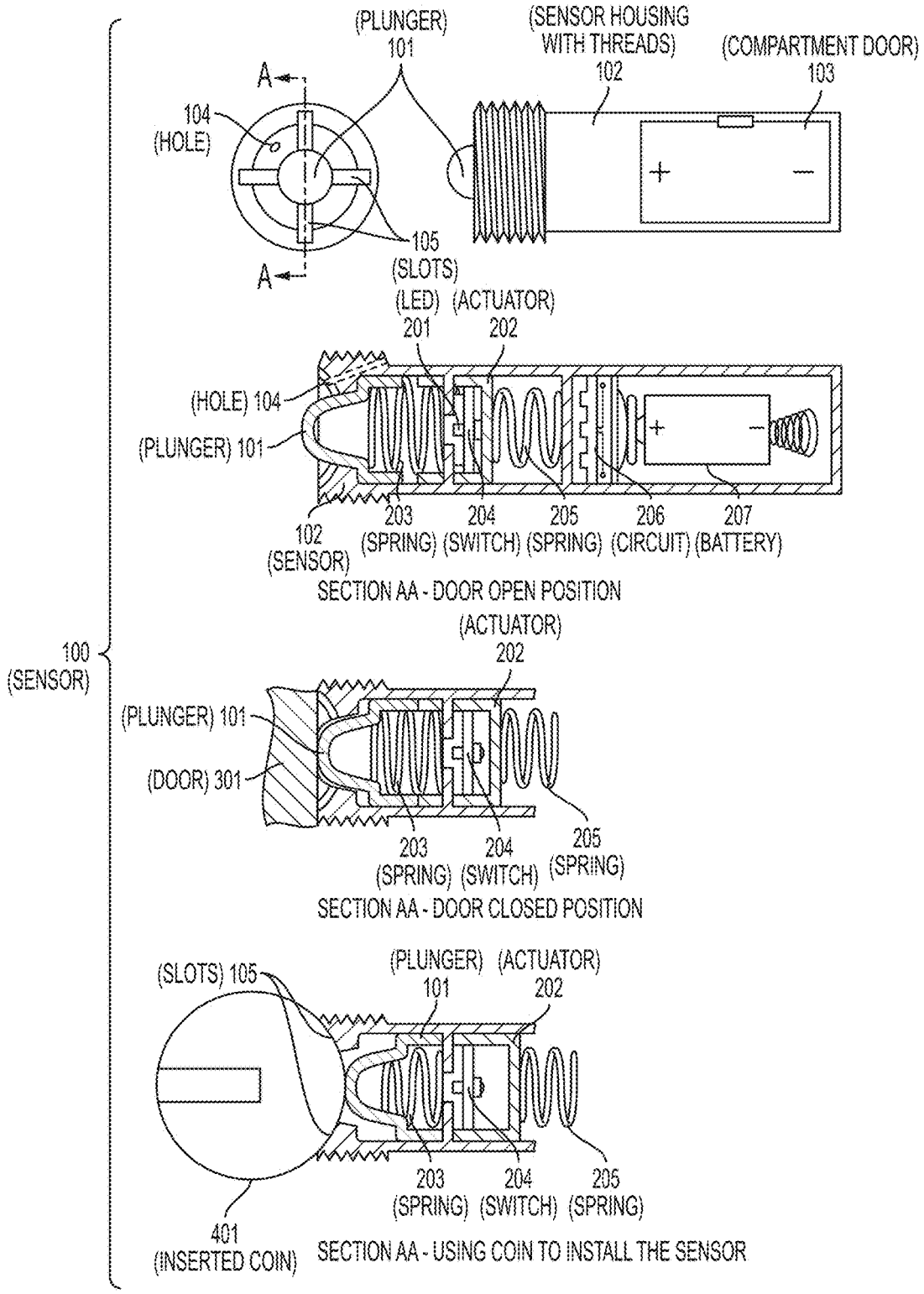
FIG. 1 shows an apparatus with a plunger, sensor housing with screw adjustment capability, and two stage spring actuation in accordance with an embodiment.

FIG. 1 shows apparatus 100 according to one or more aspects of the embodiments. Apparatus 100 comprises three external components: plunger 101, sensor housing with external screw adjustment features 102, and battery compartment door 103. Moreover, apparatus 100 supports two distinct features: "coin" driver slots 105 and set screw hole 104, a hole that reaches diagonally from the front surface to the exterior of the sensor near the base of the threaded area.

Internally, there are seven additional components: indicator LED 201, switch actuator 202, plunger spring 203, switch 204, actuator spring 205, sensor electronics (circuit) 206, and battery 207 with contacts. With some embodiments, LED 201 may be visible and may be used during pairing with the associated home automation system and to indicate a low battery state.LED 201, switch 204, and battery 207 are connected to the sensor electronics 206 using ordinary means.

Apparatus 100 may secure different types of building barriers to a surrounding frame. For example, building barrier 301, as shown in in FIG. 1, may comprise a door or a window, where the surrounding frame includes a jamb/lintel or head/jamb/sill, respectively.

Figure 2:
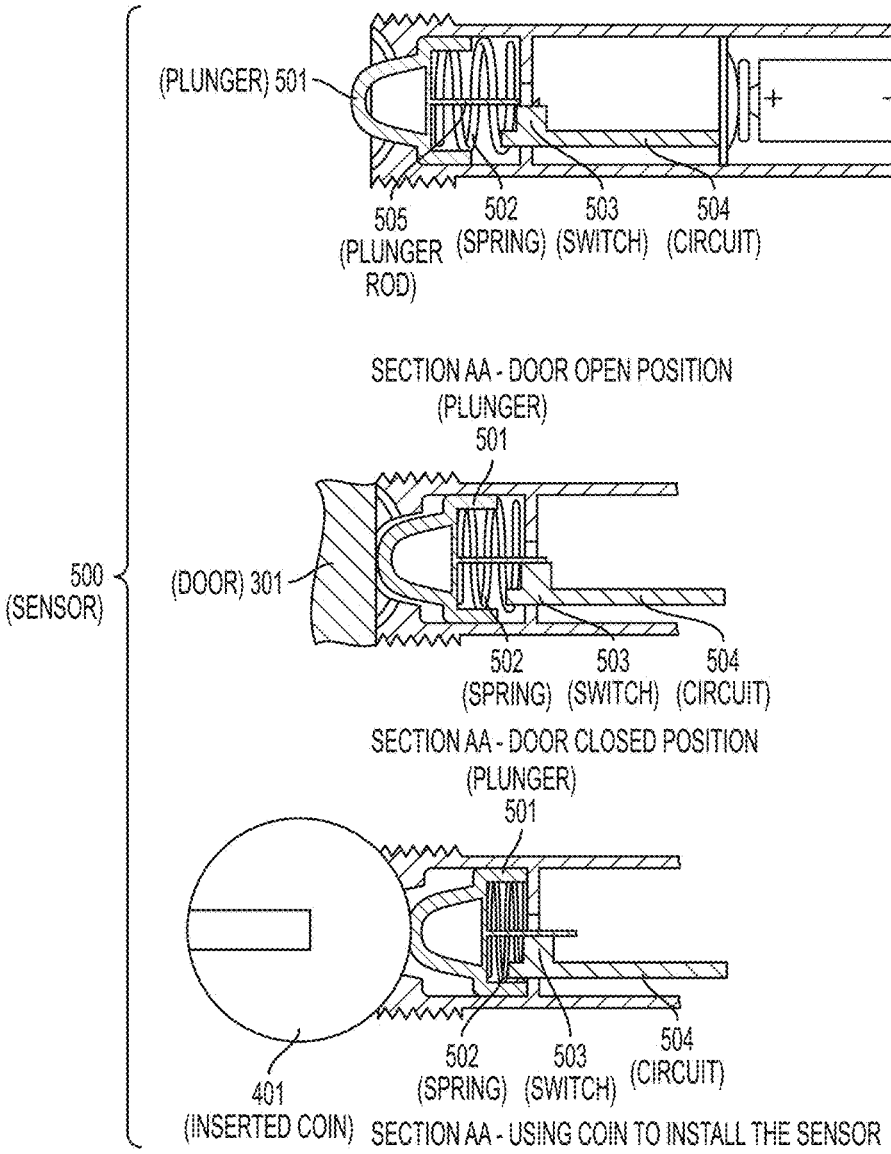
FIG. 2 shows an apparatus with an attached rod plunger, sensor housing with screw adjustment capability, and single spring actuation in accordance with another embodiment.

FIG. 2 shows apparatus 500 according to another aspect of the invention. Plunger 501 incorporates a rod that extends past the plunger spring 502 into the sensor to activate a switch 503 mounted on sensor electronics board 504.

While apparatus 100 and apparatus 500 may utilize a wireless sensor, the internal switch 503 can easily be wired to terminals on the exterior of the sensor to provide contact closure as a wired sensor. With wireless operation, the sensor electronics may comprise a micro-controller based system having memory to store computer-executable instructions, an input to sense the switch state, an output to control the LED to indicate status, and a transceiver module supporting a standard radio protocol to provide communication with other devices.

Figure 3:
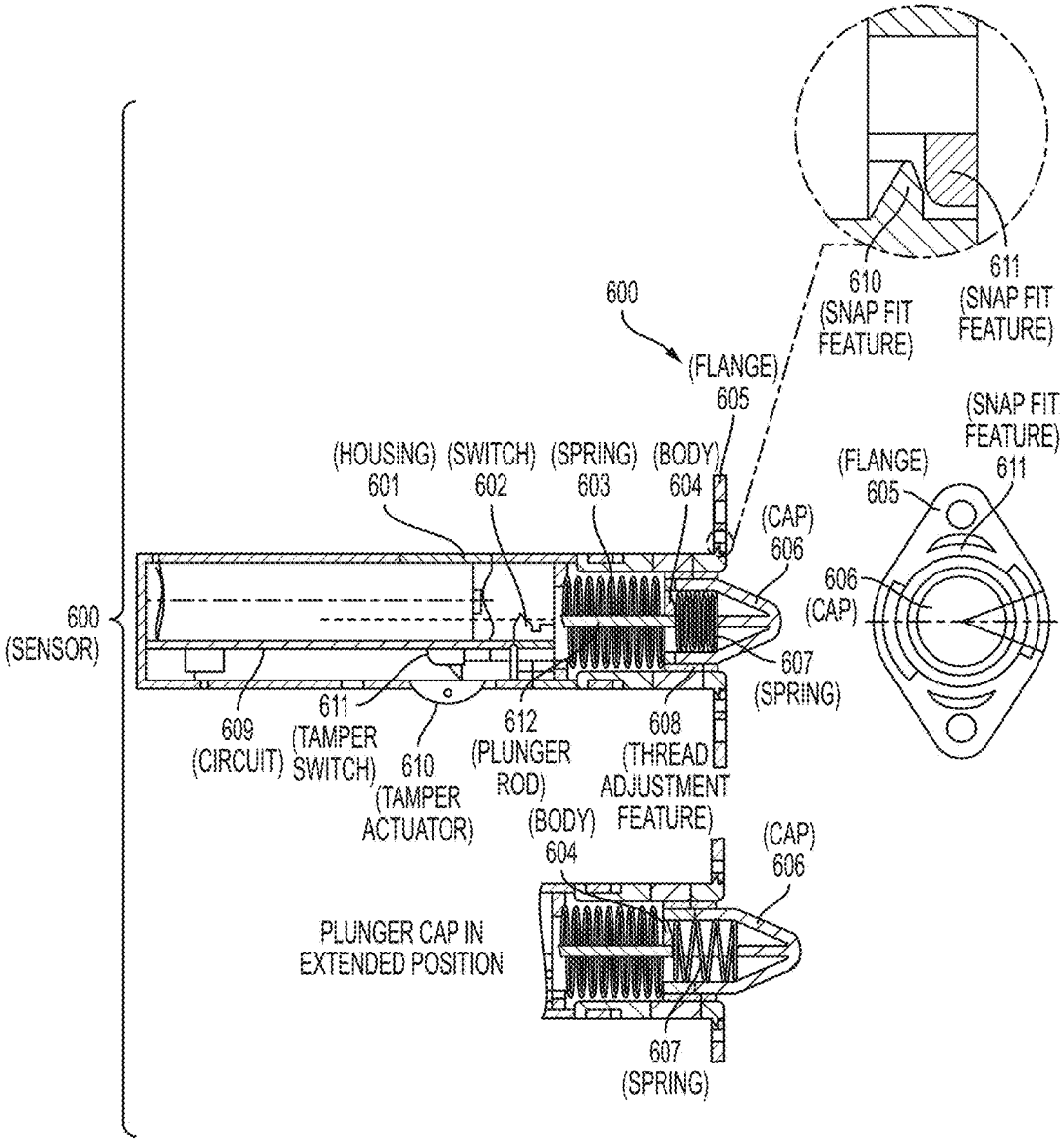
FIG. 3 shows an apparatus with tamper detection and a mounting mechanism suitable for certain door jambs in accordance with an embodiment.

FIG. 3 depicts apparatus 600 according to another aspect of the invention that is particularly suited for door jambs that do not provide enough depth to engage the external screw adjustment features of apparatus 100 or 500. Apparatus 600 comprises fixed holding frame 601 attached to mounting flange 605 with plunger cap 606 attached to plunger body 604 that includes a rod that extends into the sensor interior. Plunger cap 606 is attached to plunger body 604 via screw thread feature 608 that provides the contact adjustment capability. Tension to keep the plunger body extended is provided by plunger spring 603 while cap spring 607 keeps the plunger cap 606 extended. The electronics board 609 contains the sensor electronics, including detection switch 602.

Referring to FIGS. 1 and 2, the sensor is installed by drilling a suitably sized hole in the surrounding frame (jamb or lintel) of the door facing the door itself, i.e., not an interior or exterior facing surface. Sensor 102 is then inserted into the surrounding frame, battery end first, until the threads at the front of the sensor meet the surrounding frame. A tool, such as coin 401, is then placed in coin driver slots 105 to rotate sensor 102 and drive the sensor into the jamb or lintel. The depth to which the sensor is installed is determined by the size of the gap between the door and the jamb or lintel when the door is closed. This may be accomplished by installing the sensor so that the front of the sensor is flush with the jamb or lintel surface and the plunger 101/501 is above the surface when the coin is removed.

If the plunger does not reach sufficiently high enough to activate the switch when the door 301 or building barrier is closed, the coin tool may be used to incrementally back out the sensor until the plunger engages the building barrier, while the front surface of the sensor does not interfere with the closing of the building barrier.

Alternative embodiments may employ mechanisms other than coin driver slots to allow the sensor to be rotated for installation or extraction. Some of these mechanisms may include raised parallel surfaces similar to bolt heads or depressed features other than slots that allow purchase for a driving implement to be inserted.

If it is determined that the sensor is "loose" in the hole and may rotate under repeated door openings and closings, a small "set" screw can be screwed into the wood around the sensor via set screw hole 104 to keep the sensor from rotating. If the cover/support frame gap allows, an alternate rotation limiting mechanism may be a "nut" that the sensor may be inserted into to engage the screw threads of the sensor body and secure the sensor against the support frame. Other standard screw thread based rotation limiting mechanisms may be applied to the sensor housing.

For battery replacement, the sensor is unscrewed from the support frame until the threads are no longer engaged, after which the sensor is removed from the hole, providing access to the battery compartment door. Removal of the door allows the battery to be replaced without disturbing the internal electronics of the sensor.

Referring to FIG. 1, when properly installed, the closing of the door will cause the following sequence of events. Plunger 101 overcomes the force of plunger spring 203 and contact switch actuator 202, pushing the actuator away from switch 204 by overcoming the force of actuator spring 205. Sensor electronics 206 detects the switch change and performs whatever tasks are associated with a switch change indicating a closing door.

When opening a door, actuator spring 205 is forceful enough to push switch actuator 202 and plunger 101 out such that switch 204 becomes depressed. Sensor electronics 206 detects the switch closure and performs the tasks associated with a switch change indicating an opening door.

While actuator 202 will stop traveling, plunger spring 203 will continue to drive plunger 101 forward to keep dust and moisture intrusion from the front opening to a minimum.

Referring to FIG. 2, plunger 501 incorporates rod 505 that depresses switch 503 as it travels over the switch. Plunger spring 502 ensures that when in the "door open" position, plunger rod 505 is not depressing switch 503.

With both apparatus 100 and apparatus 500, plunger 101/501 is designed to depress beyond the front surface of sensor housing 102 to allow the use of coin 401 as a tool for rotating the sensor during installation.

For a wired sensor, the wires from the monitoring system would be attached to the terminals on the exterior of the sensor before the sensor is inserted into the hole.

Referring to FIG. 3, apparatus 600 provides an alternate embodiment using a screw adjustment mechanism internal to the sensor. The plunger cap 606 is rotated clockwise relative to the sensor body 601 until it is as short as possible. Similar to apparatus 100 and 500, a suitable hole is drilled into the door jamb or lintel and the sensor inserted battery end first. The sensor is then attached to the door jamb or lintel by screwing mounting flange 605 to the door jamb or lintel.

Similar to apparatus 500, in order to detect whether an associated door or window is opened or closed, mechanical switch 602 is triggered when rod 612 of plunger body 604 is pushed by the door contacting plunger cap 606 and travels enough to depress switch 602. In apparatus 600, if switch 602 is not activated when the door is closed, plunger cap 606 is rotated counter-clockwise, extending the cap relative to plunger body 604 due to screw adjustment feature 608 until the switch 602 is activated when the door is closed. A lip at the base of plunger cap 606 prevents the cap from becoming separated from plunger body 604.

To aid battery replacement for wireless versions of the invention, snap fit features 610 and 611 are provided to allow easy removal and replacement of sensor housing 601 for battery replacement.

To detect tampering of sensor 600 after it has been installed, a Tamper Actuator 610 is incorporated into Sensor Housing 601 to actuate internal tamper switch 611 when the sensor is installed in the support frame of the opening. Should the sensor be removed from the support frame, the sides of the hole in the support frame would no longer press on tamper actuator 610, causing as state change in tamper switch 611 that is detected by the sensor electronics in circuit 609.

The tamper mechanism can also be applied to sensors 100 and 500 with appropriate adjustments for mounting of the tamper switch on the corresponding circuit boards.

With some embodiments, apparatus 100, 500, and 600 may comprise a magnetic reed switch and magnet rather than a mechanical switch and push structure, respectively.

Should circumstances warrant, such as not enough depth in the jamb or lintel of the surrounding frame to accommodate the length of the sensor, the sensor can also be installed in the building entry barrier such that the plunger mechanism engages and disengages the surrounding frame.

Referring to FIGS. 1-2, embodiments may support a hole in either the surrounding frame or the building barrier for mounting the sensor. When the hole is located in the surrounding frame (e.g., jamb/lintel/head/sill), the plunger of the sensor engages/disengages the building barrier (e.g., door/window). When the hole is located in the building barrier, the plunger engages/disengages the surrounding frame. The hole either in the surrounding frame or the building barrier may provide purchase for the threads of the sensor, where the hole offers a mating surface for the threads. With some embodiments, the hole is machined in the material (e.g., wood) of the surrounding frame or building barrier so that the hole's surface provides the purchase for the sensor threads. With some embodiments, a sleeve may be inserted into the hole in order to provide purchase for the threads.

Figure 4:
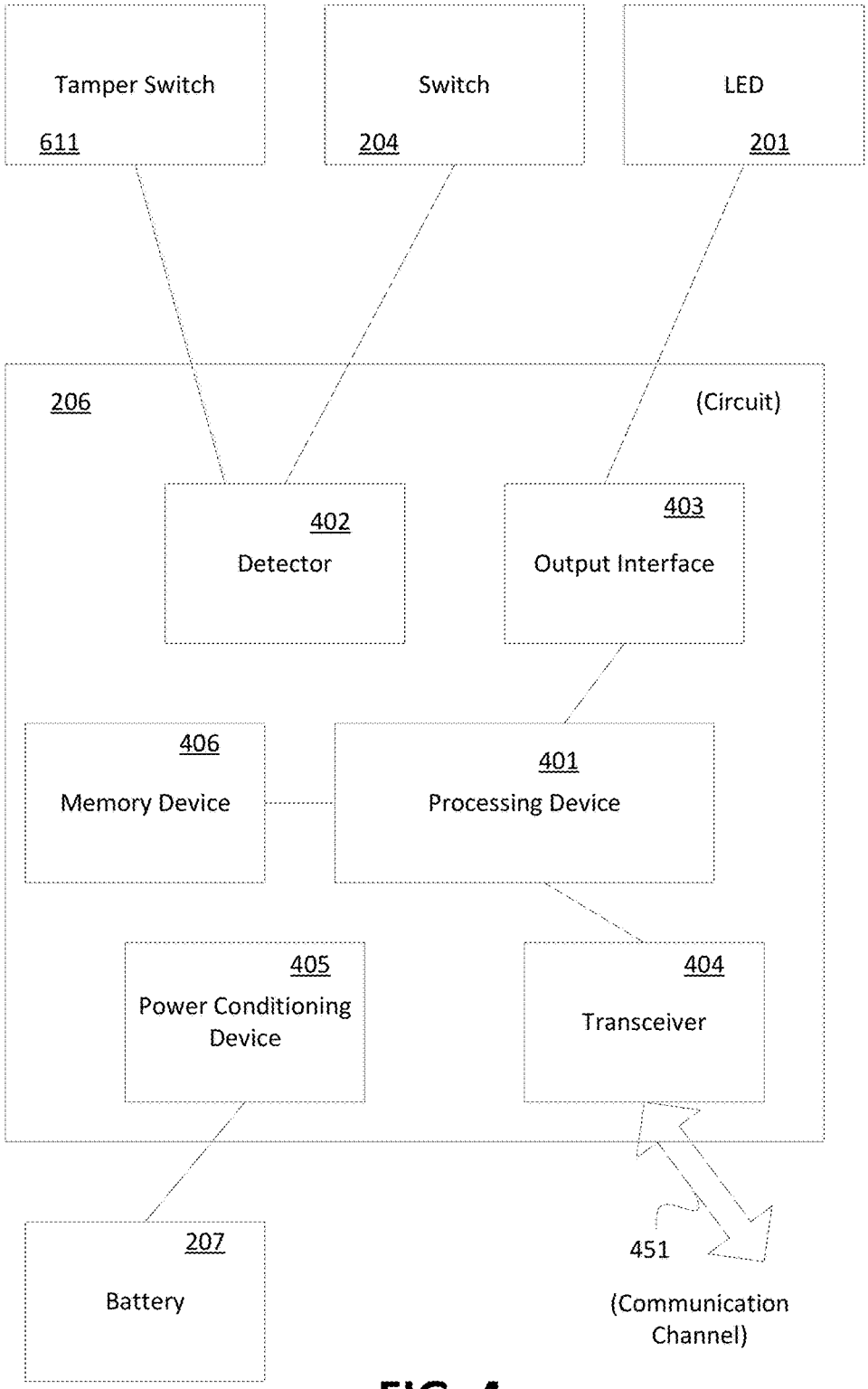
FIG. 4 shows an apparatus comprising sensor electronics circuitry in accordance with an embodiment.

Referring to FIG. 4, apparatus 206 shows a circuit supporting sensor electronics as shown in FIG. 1. Apparatus 206 comprises processing device 401, detector 402, output interface 403, transceiver 404, power conditioning device 405, and memory device 406. Moreover, electronic board 504 (shown in FIG. 2) and electronic board 609 (shown in FIG. 3) may include similar circuitry as apparatus 206.

Embodiments of the disclosure may include forms of computer-readable media that may be stored in memory device 406. Computer-readable media include any available media that can be accessed and executed by processing device 401. Computer-readable media may comprise storage media and communication media and in some examples may be non-transitory. Storage media include volatile and non-volatile, removable and non-removable media implemented in any method or technology for storage of information such as computer-readable instructions, object code, data structures, program modules, or other data. Communication media include any information delivery media and typically embody data in a modulated data signal such as a carrier wave or other transport mechanism.

Apparatus 206 is electrically connected to switch 204. For example, wires, a flexible printed circuit board, or connector posts may provide electrical connectivity. Detector 402 detects the current state of switch 204, where switch 204 is either in an opened state or closed state. The current switch status is then provided from detector 402 to processing device 401 to process the current switch status to determine state information. Processing device 401 then sends the state information to a monitoring entity (not explicitly shown) over communication channel 451 via transceiver 404. Moreover, transceiver 404 may support a standard radio protocol or proprietary radio protocol, and may communication with another radio entity (e.g., a security monitoring center not explicitly shown).

Apparatus 206 may execute logic (e.g., one or more modules stored in memory device 406 and executed by processing device 401) to process the current switch status. A first set of logic may use the switch status to determine the position of the plunger and therefore the state of the opening cover as being in the closed or opened position, Processing device 401 may also execute a second set of logic (corresponding to a tamper detection mechanism) to detect whether sensor device 100 is/has been altered (for example, removed) with respect to surrounding frame. The input to the logic may comprise of the tamper switch 610 for sensor removal, or a rotation detection mechanism (not shown) which uses one or more switches affected by rotational orientation. Should the sensor be rotated to effect removal, the rotation detection mechanism would produce a series of state changes over a period of time that may be monitored by processing device 401 to detect the rotation and therefore possible tampering of the device.

Processing device 401 may also execute a third set of logic to monitor the voltage and/or current of the battery power source to determine when replacement of the battery will be required. Such logic may be affected by the battery chemistry, or expected or historical operating behavior of the sensor.

Power conditioning device 405 conditions the electrical power characteristics from a power source (e.g., battery 207 as shown in FIG. 1) to be compatible with the required electrical characteristics of processing device 401, detector 402, output interface 403, transceiver 404, and memory device 406.

The foregoing presents a simplified summary of the disclosure in order to provide a basic understanding of some aspects. It is not intended to identify key or critical elements of the invention or to delineate the scope of the invention. Although not required, one of ordinary skill in the art will appreciate that various aspects described herein may be embodied as a method, an apparatus, or as a computer-readable medium storing computer-executable instructions (e.g., to control a plunger apparatus).

Aspects of the method steps disclosed herein, for example, may be executed on a processor on a computing device 401. Such a processor may execute computer-executable instructions stored on a computer-readable medium. For example, memory device 406 may comprise a non-transitory computer-readable medium (e.g., a CD-ROM, RAM, hard drive, flash memory, etc.) that stores instructions to cause a processor to perform methods in accordance with aspects of the disclosure is contemplated. As can be appreciated by one skilled in the art, a specialized computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry. Accordingly, those aspects may take the form of an entirely hardware embodiment or an embodiment combining software and hardware aspects.

With some embodiments, circuits 206, 504, and/or 609 may be implemented as one or more processing devices providing non-sequential and/or parallel processing such as programmable logic devices (PLDs) or application specific integrated circuits (ASICs) or other integrated circuits having instructions or logical processing for performing operations as described in connection with one or more of any of the embodiments described herein. Said instructions may be software and/or firmware instructions stored in a machine-readable medium and/or may be hard-coded as a series of logic gates and/or state machine circuits in one or more integrated circuits and/or in one or more integrated circuits in combination with other circuit elements.

Figure 5:
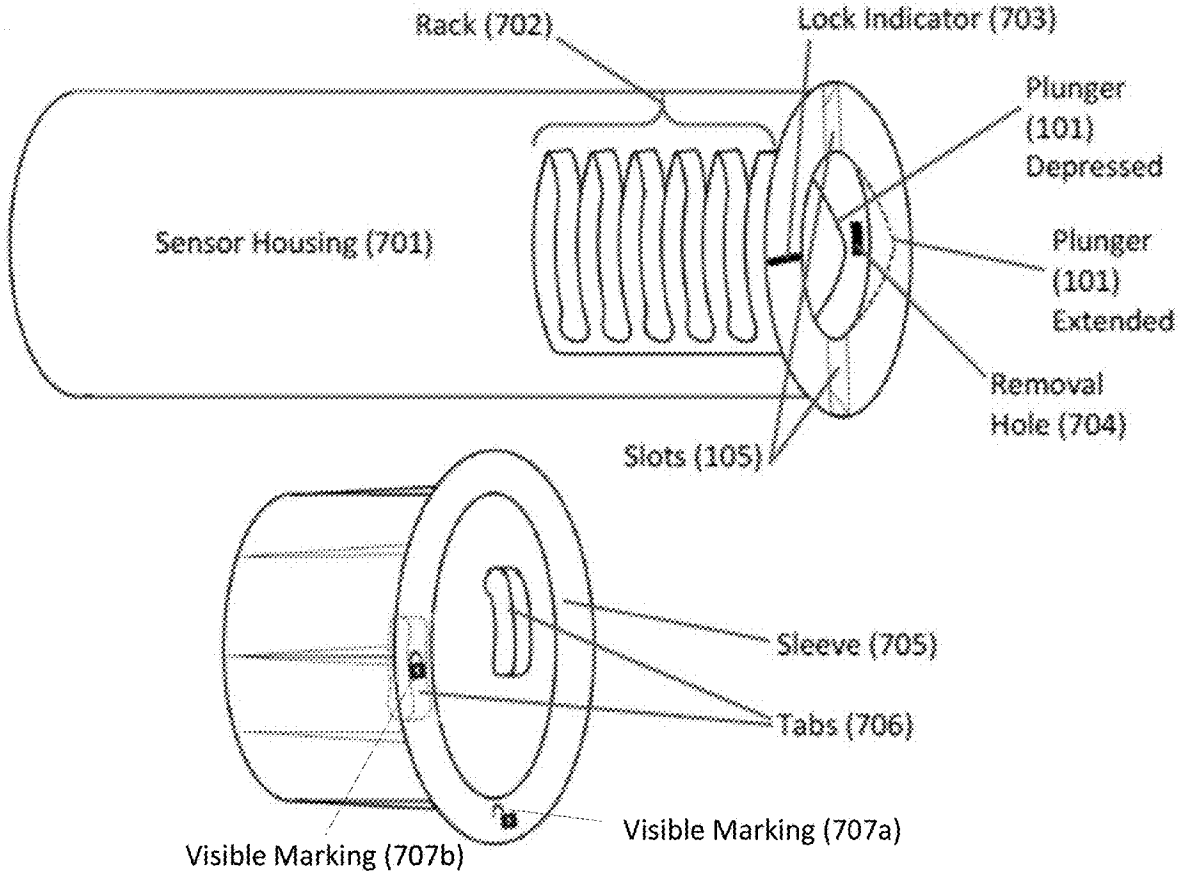
FIG. 5 shows an installation mechanism with a plunger, sensor housing with rack slots, and sleeve with tabs in accordance with an embodiment.

FIG. 5 shows an embodiment that uses a sleeve and allows for discrete gap adjustments as opposed to variable gap adjustments. The screw type mechanism in sensor housing 102 is replaced by racks 702 that creates a series of slots on opposite sides of the housing on the exterior of sensor housing 701. With some embodiments, all internal mechanisms, mechanical and electrical, for plunger detection and reporting remain the same. Installation slots 105 are also retained in sensor housing 701.

Figure 6:
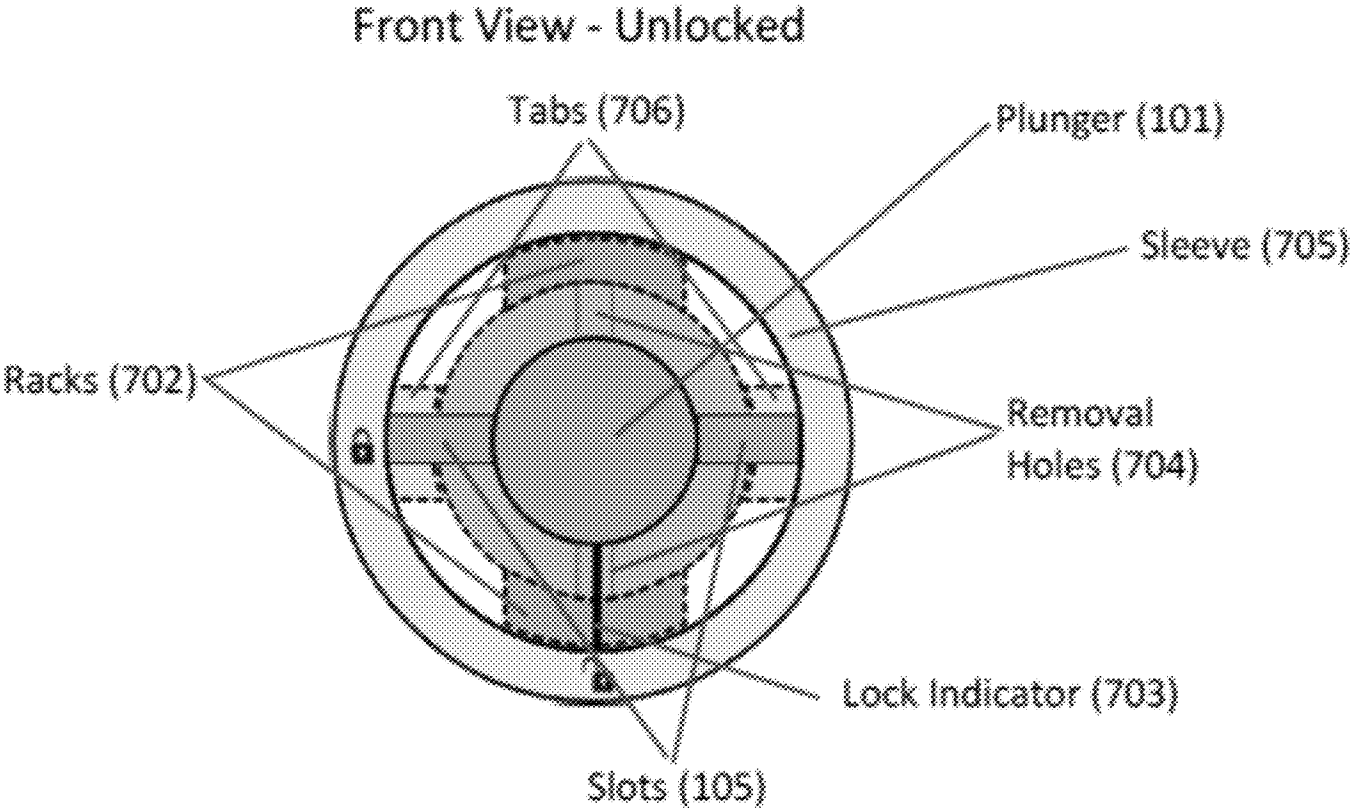
FIG. 6 shows a front view of the sensor shown in FIG. 5 in an unlocked position in accordance with an embodiment.
Figure 7:
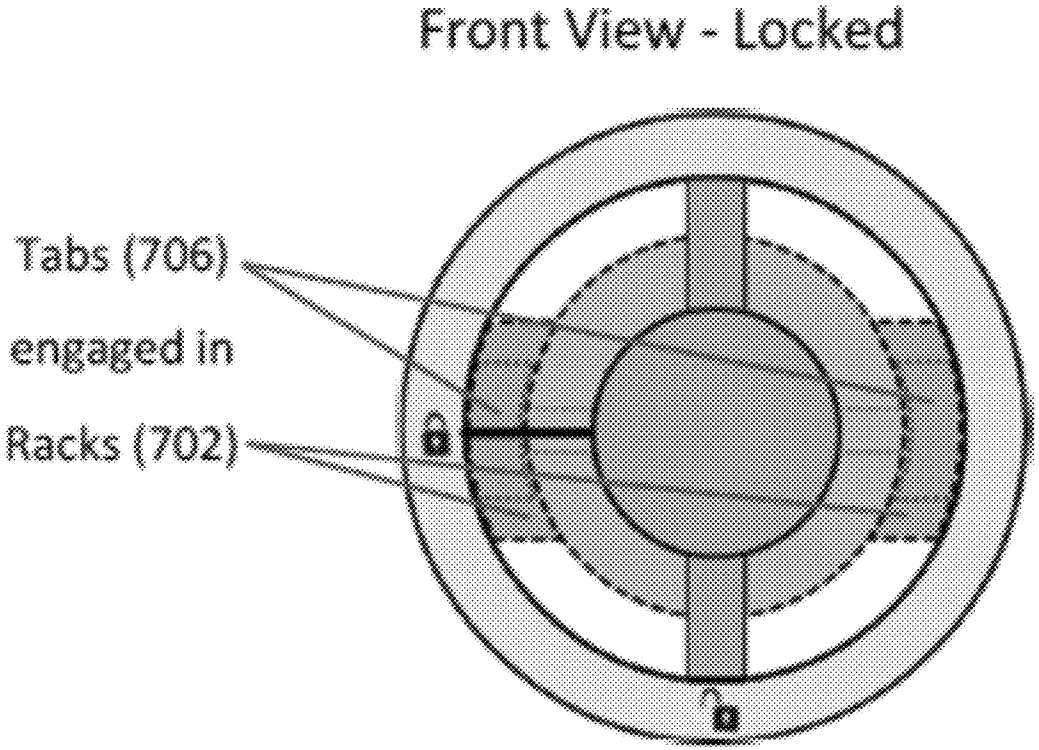
FIG. 7 shows a front view of the sensor shown in FIG. 5 in a locked position in accordance with an embodiment.

Lock indicator 703 is also added to sensor housing 701 to aid with installation. To install the sensor device, a hole is drilled into the frame similar to other embodiments, and sleeve 705 is inserted into the hole. Sensor housing 701 is then inserted into sleeve 705 oriented in the unlocked position as indicated by lock indicator 703 relative to the visible markings 707*a*,707*b* on sleeve 705. This allows racks 702 on either side of sensor housing 701 to clear tabs 706 in sleeve 705, as shown in the unlocked front view presented in FIG. 6, until the desired depth is reached. With some embodiments, sleeve 705 may have a different number of tabs (e.g., one, two, or more), where each tab engages a corresponding series of racks when in the locked position. At this point, sensor housing 701 may be rotated by hand in a clockwise manner to engage tabs 706 with racks 702. Coin 401 (referring to FIGS. 1 and 2) may be inserted in slots 105 if required to complete the rotation to the locked position as shown in the locked front view presented in FIG. 7.

To remove sensor housing 701 for maintenance, such as battery replacement, sensor housing 701 is rotated from the locked position to the unlocked position, and pulled out of sleeve 705. In situations where sensor housing 701 is installed such that it cannot be gripped by hand, a small screwdriver or stiff wire may be inserted into removal hole 704 so that sensor housing 701 may be pulled out. With some embodiments, removal hole 704 may be exposed by depressing plunger 101.

Embodiments may realize tabs 706 in different manners, for example, with protrusions toward the interior of the sleeve or with pawls that move inwardly to engage the racks.

With some embodiments, sleeve 705 comprises tabs 706 and sensor housing 701 comprises racks 702, where tabs 706 appropriately engages racks 702 to obtain the desired depth as discussed above. However, with some embodiments, the positioning of racks 702 and tabs 706 may be reversed, where sleeve 705 comprises racks 702 and sensor housing 701 comprises tabs 706.

Aspects of the invention have been described in terms of illustrative embodiments thereof. Numerous other embodiments, modifications and variations within the scope and spirit of the disclosed invention will occur to persons of ordinary skill in the art from a review of this entire disclosure. For example, one of ordinary skill in the art will appreciate that the steps illustrated in the illustrative figures may be performed in other than the recited order, and that one or more steps illustrated may be optional in accordance with aspects of the disclosure. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sensor device for a building barrier, wherein the building barrier is surrounded by a surrounding frame, the sensor device comprising:

a plunger adapted to engage either the building barrier or the surrounding frame to secure the building barrier when in a closed position and to disengage either the building barrier or the surrounding frame when the building barrier is in an opened position;

a sleeve with at least one engagement tab inserted through a hole in either the surrounding frame or the building barrier; and a sensor housing having a discrete increments adjustment mechanism, the adjustment mechanism adapted to adjust a depth of the plunger with respect to the gap between the building barrier and the surrounding frame in discrete increments, wherein the adjustment mechanism comprises:

a slotted rack portion adjustably inserted into the sleeve;

driver features enabling the slotted rack portion to be externally adjusted;

a switch having first and second states indicative of the closed and opened positions of the plunger, respectively; and a linkage coupling the plunger to the switch, wherein the linkage moves responsive to movement of the plunger.

2. A sensor device of claim 1, wherein the sensor housing further comprise a lock indicator, the lock indicator being in one of an unlocked position and a locked position.

3. A sensor device of claim 2, wherein the sleeve comprises at least one visible marking and wherein the relative positioning of the lock indicator to the at least one visible marking is indicative whether the sensor housing is in the locked position or in the unlocked position.

4. The sensor device of claim 3, wherein the at least one visible marking comprises a locked marking.

5. The sensor device of claim 3, wherein the at least one visible marking comprises an unlocked marking.

6. The sensor device of claim 1, wherein the slotted rack portion comprises a series of slots of the sensor housing. on opposite sides of the sensor housing.

7. The sensor device of claim 2, wherein the sensor housing is configurable to be in the locked position by rotating the sensor housing when inserted into the sleeve at a desired depth.

8. The sensor device of claim 7, wherein the at least one engagement tab is engaged with the slotted rack portion when in the locked position.

9. The sensor device of claim 2, wherein the slotted rack portion clears the at least one engagement tab when in the unlocked position.

10. A sensor device of claim 2, wherein the sensor housing is removable by rotating the sensor housing from the locked position to the unlocked position and by extracting the sensor housing from the sleeve.

11. A sensor device of claim 10, wherein the sensor housing further comprises a removal hole for extracting the sensor housing.

12. A sensor device of claim 11, wherein the removal hole is exposed by depressing the plunger.

13. A sensor device of claim 1, wherein the sensor housing further comprises at least one slot and wherein the sensor housing is rotatable by inserting a tool in the at least one slot.

14. A sensor device of claim 1, wherein the at least one engagement tab comprises two engagement tabs and the slotted rack portion comprises two series of slots on opposite sides of the sensor housing.

15. A sensor device for a building barrier, wherein the building barrier is surrounded by a surrounding frame, the sensor device comprising:

a plunger adapted to engage either the building barrier or the surrounding frame to secure the building barrier when in a closed position and to disengage either the building barrier or the surrounding frame when the building barrier is in an opened position;

a sleeve with a slotted rack portion inserted through a hole in either the surrounding frame or the building barrier; and a sensor housing having a discrete increments adjustment mechanism, the adjustment mechanism adapted to adjust a depth of the plunger with respect to the gap between the building barrier and the surrounding frame in discrete increments, wherein the adjustment mechanism comprises:

at least one tab adjustably inserted into the sleeve;

driver features enabling the at least one tab to be externally adjusted by engaging the slotted rack portion when in a locked position;

a switch having first and second states indicative of the closed and opened positions of the plunger, respectively; and a linkage coupling the plunger to the switch, wherein the linkage moves responsive to movement of the plunger.

* * * * *